US010137655B2

(12) United States Patent
Exner et al.

(10) Patent No.: US 10,137,655 B2
(45) Date of Patent: Nov. 27, 2018

(54) RESEALABLE PACKAGE METHOD FOR PRODUCING THE RESEALABLE PACKAGE AND APPARATUS FOR PRODUCING THE RESEALABLE PACKAGE

(71) Applicant: KRAFT FOODS R & D, INC., Deerfield, IL (US)

(72) Inventors: Ronald H. Exner, Deerfield, IL (US); Christopher W. Dunkle, Deerfield, IL (US); Jo-Ann Clark, Deerfield, IL (US); Adam Lloyd, Deerfield, IL (US)

(73) Assignee: KRAFT FOODS R&D, INC., Deerfield, IL (US)

( * ) Notice: Subject to any disclaimer, the term of this patent is extended or adjusted under 35 U.S.C. 154(b) by 45 days.

(21) Appl. No.: 14/389,087

(22) PCT Filed: Apr. 2, 2013

(86) PCT No.: PCT/EP2013/056876
§ 371 (c)(1),
(2) Date: Sep. 29, 2014

(87) PCT Pub. No.: WO2013/144363
PCT Pub. Date: Oct. 3, 2013

(65) Prior Publication Data

US 2015/0055892 A1 Feb. 26, 2015

(30) Foreign Application Priority Data

Mar. 29, 2012 (GB) ..... 1205650.3

(51) Int. Cl.
*B65D 33/16* (2006.01)
*B31B 1/90* (2006.01)
(Continued)

(52) U.S. Cl.
CPC ..... *B31B 1/90* (2013.01); *B31B 50/81* (2017.08); *B65D 33/1658* (2013.01);
(Continued)

(58) Field of Classification Search
CPC .... B65D 33/1691; B65D 33/18; B65D 33/20; B65D 2101/00; B65D 2101/0007;
(Continued)

(56) References Cited

U.S. PATENT DOCUMENTS 2,643,049 A * 6/1953 Bartelt ..... B65D 33/18 383/211
3,819,106 A * 6/1974 Schuster ..... A61B 10/0096 206/439

(Continued)

FOREIGN PATENT DOCUMENTS

EP 2361760 A1 8/2011
EP 2551211 A1 1/2013

OTHER PUBLICATIONS

ISR PCT/EP2013/056876 dated Sep. 18, 2013.

(Continued)

*Primary Examiner* — Jes F Pascua
*Assistant Examiner* — Nina Attel
(74) *Attorney, Agent, or Firm* — Cantor Colburn LLP

(57) ABSTRACT

The invention relates to a resealable package (1, 1', 1"), comprising a package body (2) having a first side wall (4), a second side wall (6) opposite the first side wall (4), an openable top end (8) and a closed bottom end (10), wherein a portion (12) of the first side wall (4) protrudes beyond the second side wall (6) at the top end (8) in a direction from the bottom end (10) to the top end (8), and a closure element (18) which is releasably adhered to an inner surface (14) of the portion (12) of the first side wall (4) which protrudes beyond the second side wall (6) and the second side wall (6)

(Continued)

so as to close the top end (8), Upon removal of the closure element (18) from the package body (2), a resealable adhesive arrangement (20, 22; 23; 25) is exposed so as to allow the inner surface (14) of the portion (12) of the first side wall (4) which protrudes beyond the second side wall (6) and an outer surface (16) of the second side wall (6) to be resealably adhered to one another in a position to close the top end (8). Further, the invention relates to a method and an apparatus (100) for producing the resealable package (1, 1', 1").

20 Claims, 9 Drawing Sheets

(51) Int. Cl.

| | |
|---|---|
| ***B65D 75/58*** | (2006.01) |
| ***B65D 75/56*** | (2006.01) |
| ***B65D 33/20*** | (2006.01) |
| ***B31B 50/81*** | (2017.01) |
| *B31B 70/81* | (2017.01) |

(52) U.S. Cl.
CPC ..... *B65D 33/1691* (2013.01); *B65D 33/20* (2013.01); *B65D 75/566* (2013.01); *B65D 75/58* (2013.01); *B65D 75/5805* (2013.01); *B65D 75/5855* (2013.01); *B31B 70/813* (2017.08)

(58) Field of Classification Search
CPC .... B65D 2101/0015; B65D 2101/0023; B65D 2101/003; B65D 2101/0038; B65D 2101/0092; B65D 2575/3218; B65D 2575/3227; B65D 2575/3236; B65D 2575/3245; B65D 75/58; B65D 75/5855; B65D 75/5894; B65D 33/22; B65D 27/06; B65D 27/28; B65D 75/66; B65D 27/30
USPC ..... 383/210.1, 78, 81, 82, 83, 203, 204, 66, 383/62
See application file for complete search history.

(56) References Cited

U.S. PATENT DOCUMENTS 4,785,940 A * 11/1988 Wilson ..... B65D 33/20 383/204
2011/0036741 A1* 2/2011 Moehlenbrock ..... B65D 33/16 206/484

OTHER PUBLICATIONS

International Preliminary Report on Patentability; International Application No. PCT/EP2013/055876; International Filing Date: Apr. 2, 2013; dated Oct. 1, 2014; 6 Pages.
Written Opinion of the International Searching Authority; International Application No. PCT/EP2013/056876; International Filing Date: Apr. 2, 2013; dated Sep. 18, 2013; 5 Pages.

* cited by examiner

RESEALABLE PACKAGE METHOD FOR PRODUCING THE RESEALABLE PACKAGE AND APPARATUS FOR PRODUCING THE RESEALABLE PACKAGE

FIELD OF THE INVENTION

The invention relates to a resealable package comprising a package body and a closure element, a method for producing the resealable package and an apparatus for producing the resealable package.

BACKGROUND ART

The current package forming equipment and technology is limited in its ability to form packages with shaped sealed ends and/or punch holes and remove the resulting scrap. In particular, conventional vertical form fill seal equipment has limitations in forming a package with a curved seal end and accumulating the resulting scrap as well as in forming a package with a seal end having a punched hole and accumulating the resulting scrap. Conventional attempts to provide the forming, cutting and scrap removal restrict the ability to change the equipment over to package multiple products. The complexity of such a change over is cost prohibitive.

In conventional technologies for producing resealable packages, a reclose feature, such as a cold seal adhesive, is printed on a film web used for producing the package in a machine direction. Hence, a line of such a printed adhesive will create pressure banding on a roll of the production equipment. Further, the cold seal adhesive printed on the film web in the machine direction will have a high coefficient of friction against a forming collar of the production equipment during the manufacturing process. This high coefficient of friction, will reduce the production line speeds and may create problems in forming the package.

Moreover, the incorporation of a feature for an easy opening of the package, such as a laser scoring or perforations, into the package material or the package forming process leads to an increase in manufacturing cost.

Summary the Invention

The present invention has been made in view of the problems identified above and it is an object of the invention to provide a resealable package which allows for a reliable reclosure of the package and can be produced in a simple and cost efficient manner. Further, the invention aims to provide a method and an apparatus for producing such a resealable package. These goals are achieved by a resealable package with the technical features of claim 1, a method with the technical features of claim 22 and an apparatus with the technical features of claim 29. Preferred embodiments of the invention follow from the dependent claims.

The invention provides a resealable package, comprising a package body having a first side wall, a second side wall opposite the first side wall, an openable top end and a closed bottom end, wherein a portion of the first side wall protrudes beyond the second side wall at the top end in a direction from the bottom end to the top end. Further, the resealable package comprises a closure element which is releasably adhered to an inner surface of the portion of the first side wall which protrudes beyond the second side wall and the second side wall so as to close the top end. Upon removal of the closure element from the package body, a resealable adhesive arrangement is exposed so as to allow the inner surface of the portion of the first side wall which protrudes beyond the second side wall and an outer surface of the second side wall to be releasably adhered to one another in a position to close the top end.

In one embodiment, the resealable package of the invention comprises two elements, i.e., the package body and the closure element, which can be produced separately and subsequently combined. That is the closure element is independently formed from the package body. In particular, the package body can be manufactured using conventional package forming equipment, e.g., by suitably processing a film web. The closure element may be produced, for example, using equipment which is commonly used for the manufacture of liner-less labels. The closure element can be shaped according to the functional requirements before it is attached to the package body. Specifically, the closure element may be cut into a predetermined shape and/or provided with one or more punched holes, e.g., serving as a hanger structure in the finished package. Moreover, the closure element may also be cut, notched or perforated in order to provide a line of weakness assisting a consumer in opening the package.

Since the above-mentioned steps of shaping the closure element can be performed before this element is attached to the package body, they can be carried out in a simple and efficient manner, eliminating the need for the shape of the closure element to be formed and the resulting scrap to be removed at a later stage of the production process by the package forming equipment. In this way, the shape of the closure element can be easily adjusted according to the requirements without having to adapt the package forming equipment. Hence, the package of the invention can be produced in a simple and cost efficient manner.

Moreover, the closure element may be provided with the resealable adhesive arrangement prior to attaching the closure element to the package body.

In an alternative embodiment, the resealable package of the invention may comprise a closure element which is integrally formed with the package body rather than being produced separately and subsequently combined. The package body can be manufactured using conventional package forming equipment to process a film web so as to form a package which incorporates a closure element. The formation of the closure element (and other auxiliary features such as hanging holes) may be made in the film web at any point during or after forming, filling or sealing of the package. In this embodiment, the closure element may be releasably adhered by a number of methods, such as employing adhesives and/or lines of weaknesses which allow the closure element to be peeled or torn off the package body.

It is preferred that the bonding strength of the resealable adhesive arrangement to the package body is chosen so as to be higher than a bonding strength of the resealable adhesive arrangement to the closure element, so that, after removal of the closure element from the package body, the resealable adhesive arrangement remains on the package body. In this way, a pattern of the resealable adhesive arrangement can be varied freely depending on the desired functionality, without the need for any changes to the package forming equipment. Further, the requirement of providing any adhesive material on a material, such as a film web, used for producing the package body is eliminated.

Moreover, decorative elements and/or information, such as a brand or company name, may be printed, onto the closure element before attaching it to the package body, thereby further simplifying the package forming process.

Once the package body and the closure element have been produced, they are combined by releasably adhering the closure element to an inner surface of the portion of the first side wall which protrudes beyond the second side wall and the second side wall so as to close the top end of the package body, thereby forming the resealable package according to an embodiment of the invention.

In one embodiment, the closure element is releasably adhered to the inner surface of the portion of the first side wall which protrudes beyond the second side wall and the outer surface of the second side wall.

In order to open the resealable package, the closure element is removed from the package body, thereby enabling access to the interior of the package through the openable top end of the package body. Subsequently, the package can be reliably resealed by resealably adhering the inner surface of the portion of the first side wall which protrudes beyond the second side wall to the outer surface of the second side wall in a position to close the top end, using the resealable adhesive arrangement. For example, the protruding portion of the first side wall may be folded over towards the bottom end of the package body and brought into adhesive contact with the outer surface of the second side wall.

The resealable package of the invention may be, for example, a bag, a pouch or the like, and can be used for containing therein any type of liquid or solid materials. In particular, the package may be used for packaging food products, such as sweets, chocolate, cookies, nuts, savoury snacks, coffee beans, coffee powder, beverages etc. In this case, the resealable functionality of the package allows for the food products to be reliably protected from the surrounding atmosphere, thus increasing the storage life of the products.

In one embodiment, the resealable adhesive arrangement comprises a resealable adhesive adhered to the inner surface of the portion of the first side wall which protrudes beyond the second side wall and/or the outer surface of the second side wall. The resealable adhesive may comprise a pressure sensitive adhesive. If a pressure sensitive adhesive is employed, then it need only be adhered to either the portion of the first side wall which protrudes beyond the second side wall or the outer surface of the second side wall. Preferably, the pressure sensitive adhesive is adhered to the portion of the first side wall which protrudes beyond the second side wall.

Alternatively, the resealable adhesive adhered to the inner surface of the portion of the first side wall which protrudes beyond the second side wall and/or the outer surface of the second side wall may comprise cold seal.

In one embodiment, a first cold seal adhesive layer is provided between the closure element and the inner surface of the portion of the first side wall which protrudes beyond the second side wall, and a second cold seal adhesive layer is provided between the closure element and the outer surface of the second side wall. A bonding strength of the first cold seal adhesive layer to the inner surface of the portion of the first side wall which protrudes beyond the second side wall is higher than a bonding strength of the first cold seal adhesive layer to the closure element, so that, after removal of the closure element from the package body, the first cold seal adhesive layer remains on the inner surface of the portion of the first side wall which protrudes beyond the second side wall.

Further, a bonding strength of the second cold seal adhesive layer to the outer surface of the second side wall is higher than a bonding strength of the second cold seal adhesive layer to the closure element, so that, after removal of the closure element from the package body, the second cold seal adhesive layer remains on the outer surface of the second side wall. In this embodiment, the resealable adhesive arrangement is formed by the first and second cold seal adhesive, layers.

Herein, the term "cold seal adhesive" has the same meaning as the terms "self-seal adhesive" and "cohesive" and defines a material which seals only to itself, i.e., to a substrate covered with the same type of material. Since a cold seal adhesive is used for the first and second adhesive layers of the package, the package can be resealed in a simple manner, namely by folding the protruding portion of the first side wall towards the bottom end of the package body so as to bring the first and second adhesive layers into contact with each other. In this state, the package is reliably sealed, thus securely protecting its contents from the surrounding atmosphere.

Further, since the first and second adhesive layers are cold seal adhesive layers, which only seal to each other, they do not interfere with consumer access to the package, e.g., by sticking to the consumer's hand. Moreover, foreign matter, such as dust, food particles or the like, do not adhere easily to the first and second adhesive layers, so that a high sealing force between the first and second adhesive layers can be reliably maintained over an extended period of time.

Due to the feature that the bonding strengths of the first and second adhesive layers to the package body are higher than their bonding strengths to the closure element, these layers can be provided on the closure element before the element is attached to the package body, thus greatly simplifying the manufacturing process of the package and enhancing the degree of freedom with regard to the application of different adhesive layer patterns.

Further, by choosing a bonding strength (sealing force) between the first adhesive layer and the second adhesive layer which is lower than the bonding strength of the first adhesive layer to the inner surface of the protruding portion of the first side wall and lower than the bonding strength, of the second adhesive layer to the outer surface of the second side wall, the integrity of the first and second adhesive layers and their proper placement on the package body can be ensured, even after repeatedly opening and resealing the package of the invention.

Moreover, the resealable package may comprise a coating layer which is provided on the closure element. This coating layer may be a layer for reducing pressure banding in the reels or rolls of the equipment used for producing the closure element. In particular, the coating layer may be provided on the closure element between the first cold seal adhesive layer and the second cold seal adhesive layer.

In one embodiment, the coating layer is a sealant layer, such as a heat or pressure activated sealant layer, forming a seal between the closure element and the top end of the package body, thereby reliably sealing the top end. In this case, the coating layer may serve to form the hermetic original seal of the package. This seal is broken by removing the closure element from the package body and, subsequently, the package may be resealed using the first and second cold, seal adhesive layers, as detailed above. In particular, the coating layer may be both a sealant layer and a layer for reducing pressure banding.

A bonding strength of the coating layer to the closure element may be higher than a bonding strength of the coating layer to the top end of the package body, so that, after removal of the closure element from the package body, the coating layer remains on the closure element. In this case, the coating layer is removed from the package body together with the closure element and thus, any interference of the coating layer with consumer access to the interior of the package or the resealing operation using the first and second cold seal adhesive layers can be reliably prevented.

Alternatively, if the coating layer is configured such that it does not interfere with the consumer access or the resealing functionality, the bonding strength of the coating layer may be chosen such that it remains on the package body after removal of the closure element.

Further, the bonding strength of the coating layer to the top end of the package body may be chosen to be higher than the bonding strengths of the first and second cold seal adhesive layers to the closure element. In this way, the coating layer may act as a tamper evidence feature, indicating whether the package is opened for the first time or whether the closure element had been previously removed and subsequently restock to the package body.

Moreover, the package of the invention may comprise a first coating layer and a second coating layer which are provided on the closure element. One or both of these layers may be layers for reducing pressure banding in the reels or rolls of the equipment used for producing the closure element. In particular, the first and second coating layers may be provided on the closure element between the first cold seal adhesive layer and the second cold seal adhesive layer.

The first coating layer may be provided between the closure element and the inner surface of the portion of the first side wall which protrudes beyond the second side wall and the second coating layer may be provided between the closure element and the outer surface of the second side wall. One or both of the first and second coating layers may be sealant layers, such as heat or pressure activated sealant layers, forming a seal between the closure element and the top end of the package body. In this case, one or both of the first and second coating layers may serve to form the hermetic original seal of the package. In particular, one or both of the first and second coating layers may be both a sealant layer and a layer for reducing pressure banding.

A bonding strength of the first coating layer to the closure element may be higher than a bonding strength of the first coating layer to the inner surface of the portion of the first side wall which protrudes beyond the second side wall, so that, after removal of the closure element from the package body, the first coating layer remains on the closure element. Further, a bonding strength of the second coating layer to the closure element may be higher than a bonding strength of the second coating layer to the outer surface of the second side wall, so that, after removal of the closure element from the package body, the second coating layer remains on the closure element.

Hence, one or both of the first and second coating layers may be configured so that they are removed, from the package body together with the closure element, thus reliably preventing the possibility of an interference with consumer access to the package interior or the resealing operation using the first and second cold seal adhesive layers. Alternatively, one or both of the coating layers may be configured so that they remain on the package body after removal of the closure element, if they do not interfere with the customer access or the resealing functionality. Further, the bonding strength of one or both of the first and second coating layers may be chosen such that one or both of the layers act as a tamper evidence feature in the manner described in detail above.

The package body and the closure element may be made of the same material or of different materials. Possible materials which may be used for the package body and/or the closure element include plastic, such as polyethylene, metal, such as aluminium, paper, cardboard and the like. In particular, the package body may be made of a material which is less robust, i.e., has a lower strength, and/or is less expensive than the material used for the closure element. For example, a thickness of the closure element may be chosen to be greater than thicknesses of the first and second side walls of the package body. The thicknesses of the closure element and/or the first and second side walls may be in a range from 0.1 to 1.0 mm, preferably 0.3 to 0.8 mm.

Specifically, a more robust material may be used for the closure element in order to provide sufficient support for hanging the package to a support element, such as a hook or the like, and/or opening the package by removing the closure element, while minimising the overall material costs. Since the package body and the closure element can be produced separately, as has been detailed above, such a use of different materials can be implemented in a simple manner, without complicating the manufacturing process.

The closure element may have a sheet-like or planar shape. For example, the closure element may be formed as a strip of a film material. In particular, the closure element may be made from a flexible sheet material, such as plastic, metal foil or paper. In this case, the closure element can easily conform to the shape of the package body, so that the package is not reduced in its flexibility. Also the package body may be made from one or more of the above-mentioned materials.

Further, the closure element may be provided with a line of weakness, such as a perforation, a cut or the like, which facilitates removal of the closure element from the package body and thus assists a consumer in opening the package. The invention further provides a method for producing a resealable package, the package comprising a package body having a first side wall, a second side wall opposite the first side wall, an openable top end and a closed bottom end, wherein a portion of the first side wall protrudes beyond the second side wall at the top end in a direction from the bottom end to the top end, and a closure element for closing the top end of the package body.

The method of the invention comprises the steps of integrally forming or applying the closure element to the package body such that the closure element is releasably adhered to an inner surface of the portion of the first side wall which protrudes beyond the second side wall and the second side wall so as to close the top end, and providing a resealable adhesive arrangement which is arranged so that, upon removal of the closure element from the package body, the resealable adhesive arrangement is exposed so as to allow the inner surface of the portion of the first side wall which protrudes beyond the second side wall and an outer surface of the second side wall to be resealably adhered to one another in a position to close the top end.

In one embodiment, the closure element is releasably adhered to the inner surface of the portion of the first side wall which protrudes beyond the second side wall and the outer surface of the second side wall.

The method of the invention provides the advantageous effects already described in detail above for the resealable package of the invention. In particular, the use of two elements, i.e., the package body and the closure element, which can be produced separately and are subsequently combined to form the package, enables a reduction of the production costs and eliminates the need for complicated modifications of the production equipment. Hence, the method can be carried out at low cost and in a simple and reliable manner.

In one embodiment, in the step of providing the resealable adhesive arrangement, the resealable adhesive arrangement is provided on the closure element and the closure element with the resealable adhesive arrangement provided thereon is releasably adhered to the inner surface of the portion of the first side wall which protrudes beyond the second side wall and the outer surface of the second side wall so as to close the top end. By providing the resealable adhesive arrangement on the closure element rather than the package body, the production process can be greatly simplified, as has been detailed above. In particular, any possible problems associated with a high coefficient of friction generated when an adhesive material is provided on a film web for forming the package body, such as a reduction of the production line speeds and a detrimental effect on the package formation, can be reliably prevented.

In one embodiment, the method further comprises the step of providing one or more coating layers on the closure element. The one or more coating layers can be layers for reducing pressure banding in the reels or rolls of the equipment used for producing the closure element and/or sealant layers, such as heat or pressure activated sealant layers, for forming a seal between the package body and the closure element. In particular, the one or more coating layers may be coating layers as described above for the resealable package of the invention.

Moreover, the method may further comprise the step of cutting the closure element into a predetermined shape prior to the step of releasably adhering the closure element to the inner surface of the portion of the first side wall which protrudes beyond the second side wall and the outer surface of the second side wall so as to close the top end. The cutting step may include cutting the closure element into a desired shape, such as a curved shape, punching one or more holes into the closure element and/or providing a line of weakness in the closure element, such as a perforation, a cut or the like, in order to assist a consumer in removing the closure element from the package body.

The resealable adhesive arrangement may comprise a resealable adhesive adhered to the inner surface of the portion of the first side wall which protrudes beyond the second side wall and/or the outer surface of the second side wall. The resealable adhesive may comprise a pressure sensitive adhesive.

The method of the invention is a method for producing the resealable package of the invention. Hence, the further features disclosed in connection with the above description of the resealable package may also be applied to the method of the invention.

The invention further provides an apparatus for producing a resealable package, the package comprising a package body having a first side wall, a second side wall opposite the first side wall, an openable top end and a closed bottom end, wherein a portion of the first side wall protrudes beyond the second side wall at the top end in a direction from the bottom end to the top end, and a closure element for closing the top end of the package body.

The apparatus comprises an attachment device configured to releasably adhere the closure element to an inner surface of the portion of the first side wall which protrudes beyond the second side wall and the second side wall so as to close the top end, and an adhesive applying device configured to provide a resealable adhesive arrangement which is arranged so that, upon removal of the closure element from the package body, the resealable adhesive arrangement is exposed so as to allow the inner surface of the portion of the first side wall which protrudes beyond the second side wall and an outer surface of the second side wall to be resealably adhered to one another in a position to close the top end.

Hence, the apparatus of the invention provides the advantageous effects already disclosed above in connection with the description of the resealable package and the method of the invention.

In one embodiment, the attachment device is configured to releasably adhere the closure element to the inner surface of the portion of the first side wall which protrudes beyond the second side wall and the outer surface of the second side wall so as to close the top end.

Any type of device which is capable of applying the pressure required for releasably adhering the closure element to the package body may be used as the attachment device. In particular, the attachment device may comprise a pair of rollers having a nip with a predetermined width formed therebetween. In this case, the package body and the closure element may be guided through the nip between the rollers so that the pressure applied to the closure element and the package body by the rollers effects a releasable adhesion of the closure element to the top end of the package body. Alternatively, a press unit or the like may be used as the attachment device. The adhesive applying device may be any type of device which is capable of applying one or more layers of an adhesive material to the closure element and/the package body.

Moreover, the adhesive applying device may be configured to provide the resealable adhesive arrangement on the closure element and the attachment device may be configured to releasably adhere the closure element with the resealable adhesive arrangement provided thereon to the inner surface of the portion of the first side wall which protrudes beyond the second side wall and the outer surface of the second side wall so as to close the top end. In this case, the apparatus is configured to provide the resealable adhesive arrangement on the closure element rather than the package body, thus greatly simplifying the production process, as has been detailed above.

The apparatus may further comprise a coating device configured to provide one or more coating layers an the closure element. The one or more coating layers can be layers for reducing pressure banding in the reels or rolls of the equipment used for producing the closure element and/or sealant layers, such as heat or pressure activated sealant layers, for forming a seal between the package body and the closure element. In particular, the one or more coating layers may be coating layers as described above for the resealable package of the invention.

The coating device may be provided in the apparatus before or after the adhesive applying device. Further, a plurality of coating devices may be arranged in the apparatus. Alternatively, the adhesive applying device may be configured so that it not only provides the resealable adhesive arrangement but also one or more coating layers as described above.

In one embodiment, the apparatus further comprises a cutting device configured to cut the closure element into a predetermined shape and the attachment device is configured to releasably adhere the closure element which has been cut into the predetermined shape to the inner surface of the portion of the first side wall which protrudes beyond the second side wall and the cuter surface of the second side wall so as to close the top end.

Herein, the term "cutting device" refers to any type of device which is capable of shaping the closure element, e.g., by cutting, hole punching, perforating or the like. In particular, the cutting device may be configured to cut, notch and/or perforate the closure element in order to provide a line of weakness assisting a consumer in opening the package. Further, a plurality of cutting devices may be arranged in the apparatus. These cutting devices may be configured so that each or some of them perform a different shaping process, such as cutting hole punching, notching, perforating and the like.

The apparatus of the invention is configured to produce the resealable package of the invention. Therefore, the features disclosed in connection with the above discussion of the resealable package may also be applied to the apparatus of the invention.

BRIEF DESCRIPTION OF THE DRAWINGS

Hereinafter, non-limiting examples are explained, with reference to the drawings, in which.

DETAILED DESCRIPTION OF CURRENTLY PREFERRED EMBODIMENTS

Figure 1:
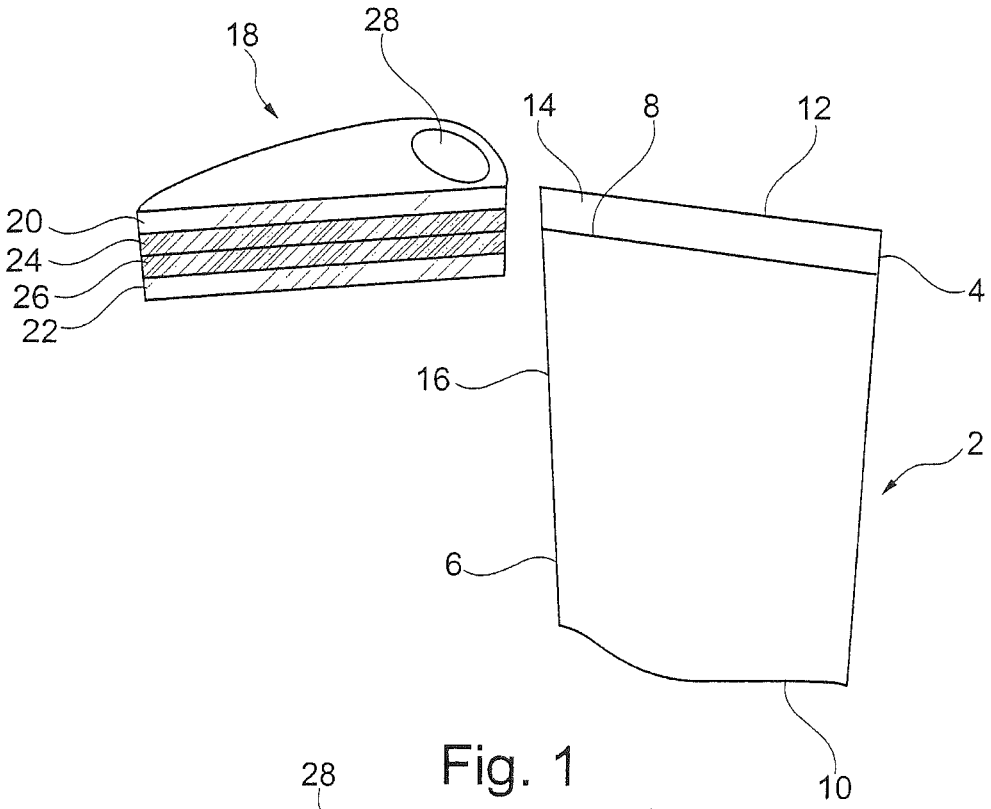
FIG. 1 snows a schematic view of a package body and a closure element of a resealable package according to an embodiment of the present invention.

FIG. 1 shows a schematic view of a package body 2 and a closure element 18 of a resealable package 1 (see FIG. 2) according to an embodiment of the invention in a state before the initial attachment of the closure element 18 to the package body 2.

The package body 2 has a first side wall 4 and a second side wall 6 opposite the first side wall 4, which are joined together at their lateral and bottom edges, e.g., by heat welding or the like, so as to form, an openable or open top end 8 and a closed bottom end 10 of the package body 2. The first side wall 4 is longer than the second side wall 6 in a direction from the bottom end 10 to the top end 8 of the package body 2, so that a portion 12 of the first side wall 4 protrudes beyond the second side wall 6 at the top end 8 in this direction. Hence, an inner surface 14 of this protruding portion 12 is exposed.

As can be seen from FIG. 1, the closure element 18 is cut into a curved shape and has a punched hole 28 which serves as a hanger element for hanging the finished resealable package. 1 (see FIG. 2) onto a support element, such as a hook. The closure element 18 has provided thereon a first cold seal adhesive layer 20 and a second cold seal adhesive layer 22 as well as a first coating layer 24 and a second coating layer 26, wherein the first and second coating layers 24, 26 are provided between the first and second cold seal adhesive layers 20, 22. The adhesive layers 20, 22 and the coating layers 24, 26 are provided as longitudinal strips extending in a direction perpendicular to the direction from the bottom end 10 to the top end 8 of the package body 2. The first and second coating layers 24, 26 are sealant layers for forming a seal between the closure element 18 and the top end 8 of the package body 2 so as to reliably seal the package 1.

The closure element 18 and the first and second side walls 4, 6 of the package body 2 are made of a plastic film material, such as polyethylene, having a thickness in the range from 0.1 to 1.0 mm. The width of the closure element 18 in the lateral direction of the package body 2, i.e., in the direction perpendicular to the direction from the bottom end 10 to the top end 8 of the package body 2, is substantially identical to the width of the package body 2. However, alternatively, the width of the closure element 18 may be chosen so as to be different from, e.g., smaller than, the width of the package body 2.

The resealable package 1 according to the embodiment of the invention is obtained by releasably adhering the closure element 18 to the top end. 8 of the package body 2, so that the first cold seal adhesive layer 20 and the first coating layer 24 are arranged between the closure element 18 and the inner surface 14 of the portion 12 of the first side wall 4 which protrudes beyond the second side wall 6 and the second cold seal adhesive layer 22 and the second coating layer 26 are arranged between the closure element 18 and an outer surface 16 of the second side wall 6. Depending on the type of sealant used for the first and second coating layers 24, 26, e.g., a heat activated sealant or a pressure activated sealant, the package 1 is sealed by applying an appropriate amount of pressure and/or heat to the closure element 18 and/or the package body 2.

Figure 2:
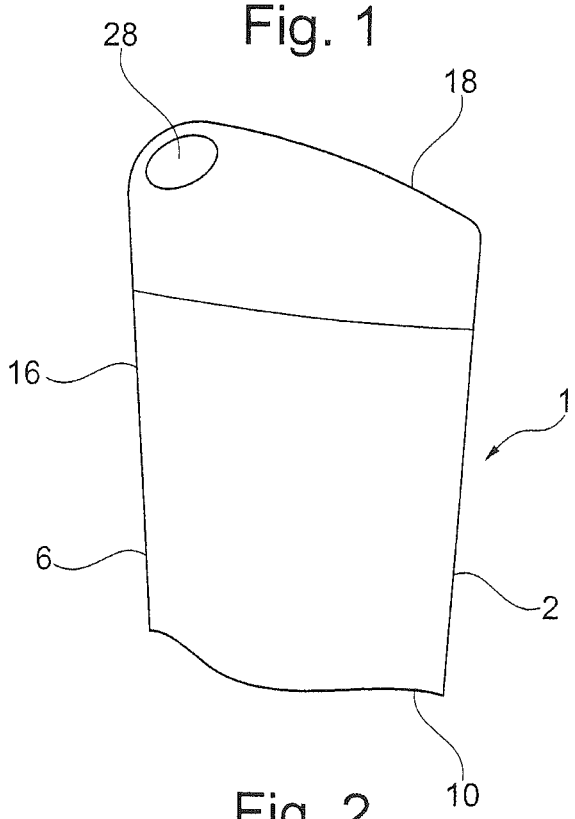
FIG. 2 shows a schematic view of the resealable package obtained by attaching the closure element shown in FIG. 1 to the top end of the package body shown, in FIG. 1.

The package 1 in it assembled state, i.e., with the closure element 18 attached to the top end 8 of the package body 2, is schematically shown in FIG. 2. In this state, the package 1 is reliably sealed by the seal between the closure element 18 and the top end 8 of the package body 2 effected by the first and second coating layers 24, 26.

The process of the initial opening and subsequent resealing of the package 1 is illustrated in FIGS. 3 to 6. As can be seen from FIG. 3, if the closure element 18 is removed from the package body 2, the first and second cold seal adhesive layers 20, 22, which were initially provided on the closure element 18 (see FIG. 1), remain on the inner surface 14 of the protruding portion 12 of the first side wall. 4 and the outer surface 16 of the second side wall 6, respectively, since their bonding strengths to the package body 2 are chosen to be higher than their bonding strengths to the closure element 18.

However, the bonding strengths of the first and second coating layers 24, 26 to the closure element 18 are chosen to be higher than their bonding strengths to the inner surface 14 of the protruding portion 12 of the first side wall 4 and the outer surface 16 of the second side wall 6, respectively, so that the coating layers 24, 26 remain on the closure element 18 and are removed from the package body 2 together with the closure element 18.

When the closure element 18 is removed from the package body 2, the seal effected by the first and second coating layers 24, 26 is broken and the openable top end 8 of the package body 2 is exposed, so that an interior of the package body 2, storing therein a liquid or solid product or products, such as food products (sweets, chocolate, cookies, nuts, savoury snacks, coffee beans, coffee powder, beverages etc.), becomes accessible to a consumer. The fully opened state, of the package 1 is schematically shown, in FIG. 4. Since a cold seal adhesive material is used for the first and second adhesive layers 20, 22, these adhesive layers 20, 22 do not interfere with the consumer access to the interior of the package body 2, e.g., by sticking to the consumer's hand.

In order to reseal the package 1, the protruding portion 12 of the first side wall 4 is folded over towards the bottom end 10 of the package body 2 so as to bring the first cold seal adhesive layer 20 into contact with the second cold seal adhesive layer 22. The first and second cold seal adhesive layers 20, 22 are made to resealably adhere to one another by applying a slight pressure to the top end 8 of the package body 2.

Figure 6:
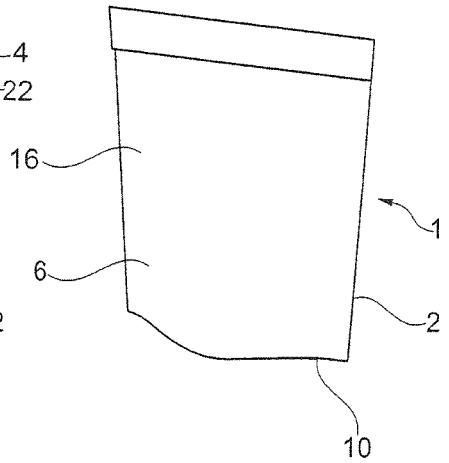
FIG. 6 shows a schematic view of the resealable package shown in FIGS. 2 to 5 in a resealed state.

The package 1 in its fully resealed state is shown in FIG. 6. In this state, the openable top end 8 of the package body 2 is reliably sealed by the adhesion of the first cold seal adhesive layer 20 to the second cold seal adhesive layer 22. Subsequently, the package 1 may be reopened by pulling the protruding portion 12 of the first side wall 4 of the package body 2 away from the outer surface 16 of the second side wall 6 of the package body 2, so as to bring the package body 2 into the opened state shown in FIG. 4. Since the first and second adhesive layers 20, 22 are made from a cold seal adhesive material, such opening and resealing operations can be repeatedly performed without affecting the bonding strength of the first and second adhesive layers 20, 22 to one another. Hence, a reliable seal of the package 1 can be ensured over an extended period of time.

As has been detailed above, since the closure element 18 can be produced separately from the package body 2, there are substantially no restrictions with regard to different patterns for the first and second adhesive layers 20, 22 and the first and second coating layers 24, 26 to be applied to the closure element 18. Examples for such different patterns are shown in FIG. 7(*a*) to (*d*) and 8(*a*) to (*d*), wherein the same reference signs as in FIGS. 1 to 6 are used, for reasons of simplicity.

Figure 7:
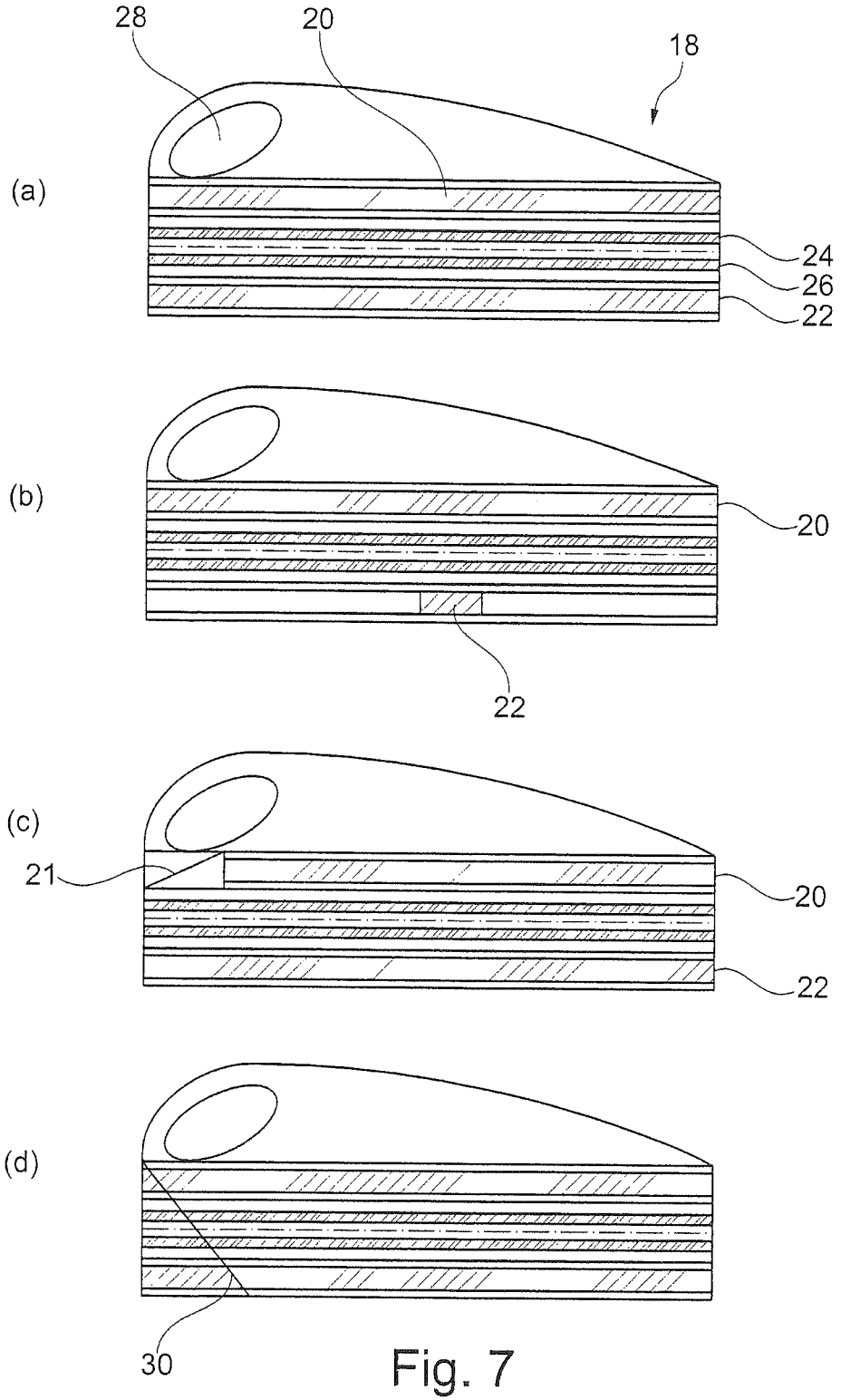
FIG. 7(*a*) to (*d*) show schematic views illustrating different embodiments of the closure element of the resealable package according to the present invention.

The closure element 18 shown in FIG. 7(*a*) differs from the closure element 18 shown in FIG. 1 in that the first cold seal adhesive layer 20 has a smaller width than the second cold seal adhesive layer 22. Alternatively, as can be seen from FIG. 7(*b*), an adhesive layer with a smaller width may be used for the second cold seal adhesive layer 22. Further, both the first and second adhesive layers 20, 22 may have a width which is smaller than the width of the closure element 18.

The closure element. 18 shown in FIG. 7(*c*) differs from the closure element 18 shown in FIG. 1 in that the first cold seal adhesive layer 20 has an inclined edge section 21, leaving a triangular area below the punched hole 28 of the closure element 18 devoid of any adhesive material. This configuration of the first cold seal adhesive layer 20 assists in removing the closure element. 18 from the package body 2 by holding the closure element 18 in the area of the punched hole 28 and peeling the closure element 18 off the package body 2 in the manner schematically shown in FIG. 3.

Another means for assisting a consumer in initially opening the package 1 is shown in FIG. 7(*d*). Specifically, the closure element 18 shown in this figure differs from the closure element 18 shown in FIG. 1 in that it has a line of weakness 30, such as a perforation or a cut, which extends from the bottom end of the closure element 18 to the upper end of the first cold seal adhesive layer 20. When removing the closure element 18 from the package body 2, the closure element 18 may be held at the area of the punched hole 28 and peeled off the package body 2 in the manner schematically shown in FIG. 3, thereby rupturing the line of weakness 30. In this case, a portion of the closure element 18, namely the triangular area below the line, of weakness 30 (i.e., the area of the lower left corner in FIG. 7(*d*)), remains on the package body 2 after removal of the closure element 18.

Figure 8:
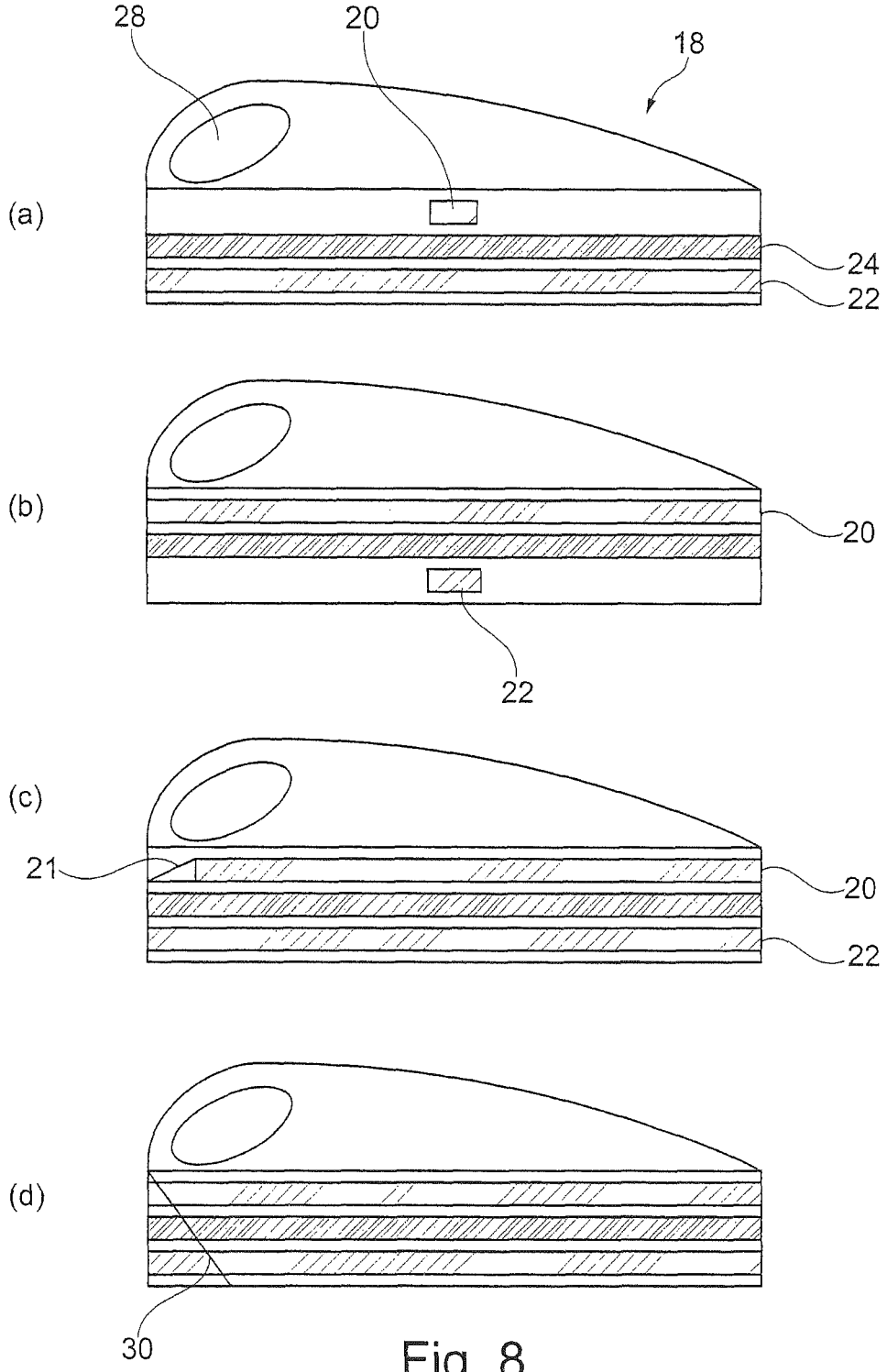
FIG. 8(*a*) to (*d*) show schematic views illustrating different embodiments of the closure element of the resealable package according to the present invention.

Instead of first and second coating layers 24, 26, a single coating layer 24 may be provided on the closure, element 18, as can be seen from FIG. 8(*a*) to (*d*). Specifically, the closure elements 18 shown in FIG. 8(*a*) to (*d*) differ from the closure elements 18 shown in FIG. 7(*a*) to (*d*) in that the first and second coating layers 24, 26 are replaced by a single coating layer 24. In this case, the single coating layer 24 may be arranged so that an upper portion of the coating layer 24 is provided between the closure element 18 and the inner surface 14 of the protruding portion 12 of the first side wall 4 and a lower portion of the coating layer 24 is provided between the closure element 18 and the outer surface 16 of the second side wall 6. If the single coating layer 24 is a sealant layer, a seal is thus formed, between the closure element 18 and the top end 8 of the package body 2 by the coating layer 24.

Figure 9:
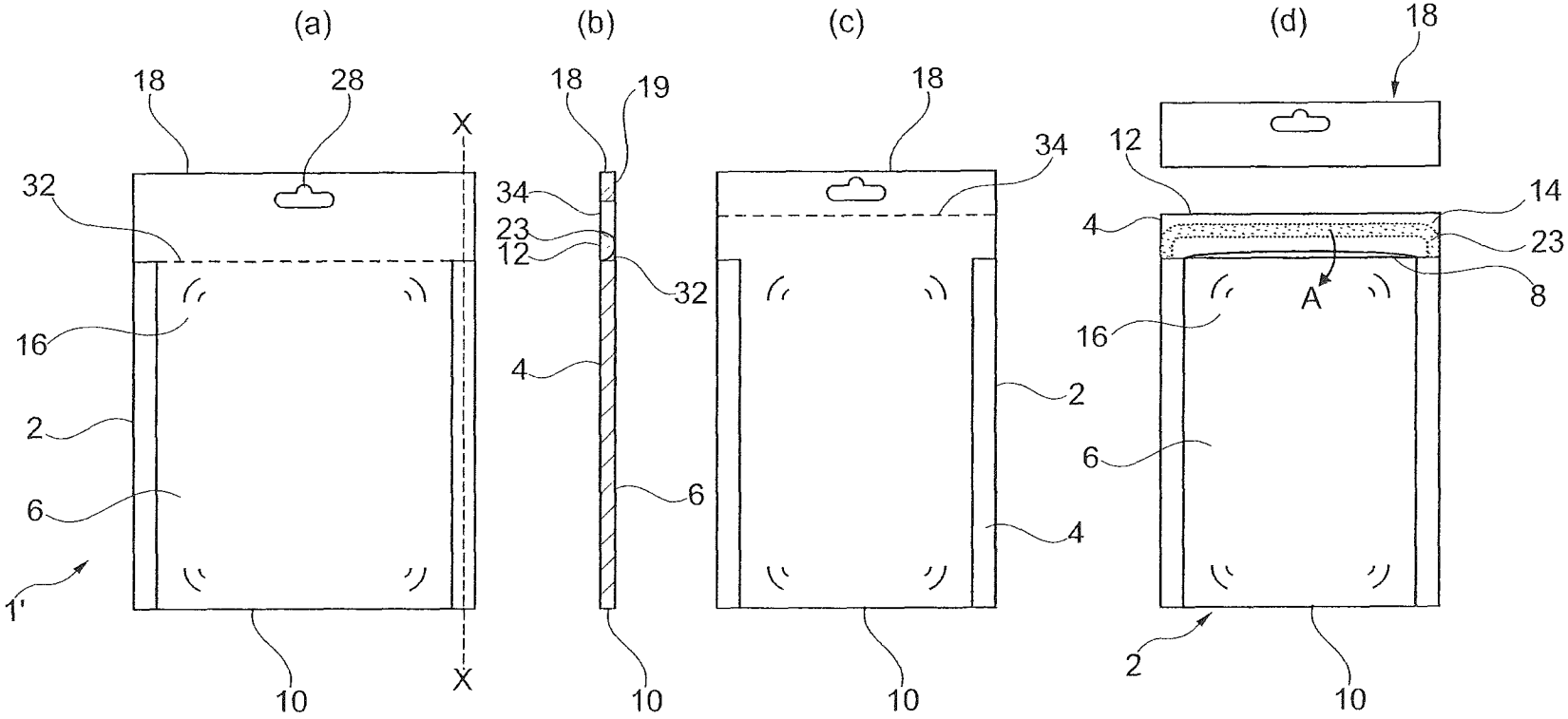
FIG. 9(*a*) to (*d*) show schematic views illustrating a resealable package according to another embodiment of the present invention, wherein FIG. 9(*a*) is a front view of the package, FIG. 9(*b*) is a cross sectional view of the package along the line X-X shown in FIG. 9(*a*), FIG. 9(*c*) is a rear view of the package and FIG. 9(*d*) is a front view of the package with the closure element being removed from the package.

FIG. 9(*a*) to (*d*) show schematic views illustrating a resealable package 1' according to another embodiment of the present invention. FIG. 9(*a*) is a front view of the package 1', FIG. 9(*b*) is a cross-sectional view of the package 1' along the line X-X shown in FIG. 9(*a*), FIG. 9(*c*) is a rear view of the package 1' and FIG. 9(*d*) is a front view of the package 1' with the closure element 18 being removed from the package 1'. For reasons of simplicity, the same reference signs as in FIGS. 1 to 6 are used to denote similar or identical elements.

The package 1' of the embodiment shown in FIG. 9(*a*) to (*d*) differs from the package 1 of the embodiment shown in FIGS. 1 to 6 mainly in that the closure element 18 is integrally formed with the package body 2. A layer of a resealable adhesive 23, such as a pressure sensitive adhesive, is provided between the closure element 18 and the inner surface 14 of the portion 12 of the first side wall 4 which protrudes beyond the second side wall 6. A bonding strength of the resealable adhesive layer 23 to the inner surface 14 of the portion 12 of the first side wall 4 which protrudes beyond the second side wall 6 is higher than a bonding strength of the resealable adhesive layer 23 to the closure element 18, so that, after removal of the closure element 18 from the package body 2, the resealable adhesive layer 23 remains on the inner surface 14 of the portion 12 of the first side wall 4 which protrudes beyond the second side wall 6, as is schematically shown in FIG. 9(*d*).

A first line of weakness 32, such as a perforation, a score line or the like, is provided in the second side wall 6 so as to extend in a widthwise direction of the package 1', i.e., in a direction substantially perpendicular to the direction from the bottom end 10 to the top end 8 (see FIG. 9(*a*)). Preferably, the first line of weakness 32 extends across the entire width of the package 1'. Further, a second line of weakness 34, such as a perforation, a score line or the like, is provided in the first side wall 4 so as to extend in a widthwise direction of the package 1' (see FIG. 9(*c*)). Preferably, the second line of weakness 34 extends across the entire width of the package 1'. As can be seen, for example, from FIG. 9(*b*), the first line of weakness 32 is arranged below the resealable adhesive layer 23 and the second line of weakness 34 is arranged above the resealable adhesive layer 23 in the direction from the bottom end 10 to the top end 8.

Figure 3:
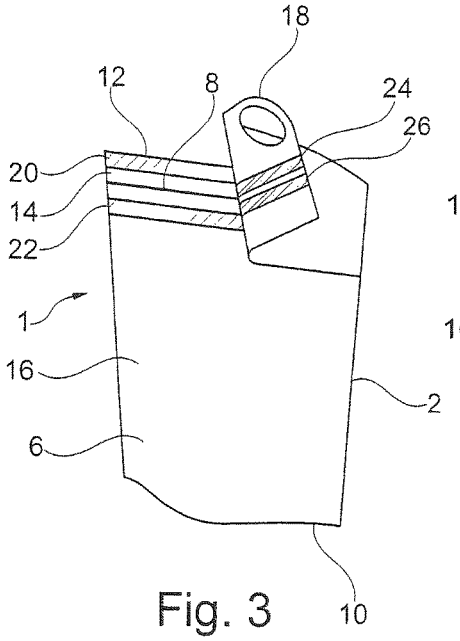
FIG. 3 shows a schematic view illustrating the process of removing the closure element from the package body of the resealable package shown in FIG. 2.
Figure 4:
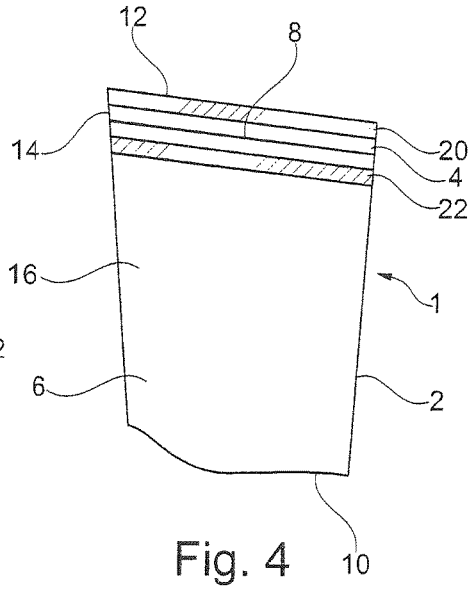
FIG. 4 shows a schematic view of the package body of the resealable package shown in FIGS. 2 and 3 after the complete removal of the closure element.
Figure 5:
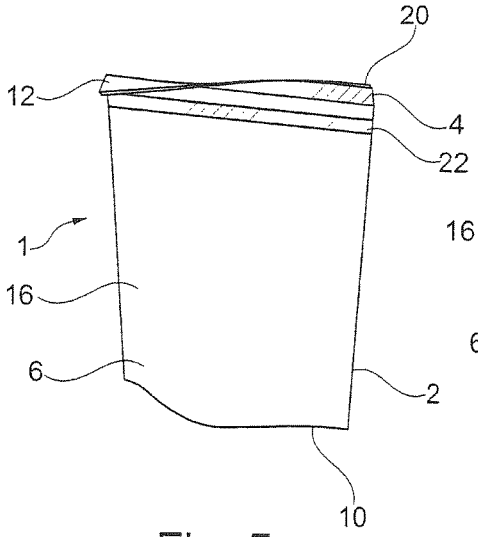
FIG. 5 shows a schematic view illustrating the process of resealing the resealable package shown in FIGS. 2 to 4.

The first and second lines of weakness 32, 34 facilitate removal of the closure element 18 from the package body 2 and thus assist a consumer in opening the package 1', as will be detailed in the following. In order to remove the closure element 18 from the package body 2, the closure element 18, for example, may be held at the area of the punched hole 28 and peeled off the package body 2 in the same manner as schematically shown in FIG. 3, thereby rupturing the first and second lines of weakness 32, 34. In this way, the closure element 18 is fully removed from the package body 2, while the resealable adhesive layer 23 remains on the inner surface 14 of the portion 12 of the first side wall 4 which protrudes beyond the second side wall 6 (see FIG. 9(*d*)).

In order to reseal the package 1', the protruding portion 12 of the first side wall 4 is folded over towards the bottom end 10 of the package body 2 in the direction indicated by arrow A in FIG. 9(*d*), so as to bring the resealable adhesive layer 23 into contact with the outer surface 16 of the second side wall 6. The resealable adhesive layer 23 and the outer surface 16 are made to resealably adhere to one another by applying a slight pressure to the top end 8 of the package body 2.

Figure 10:
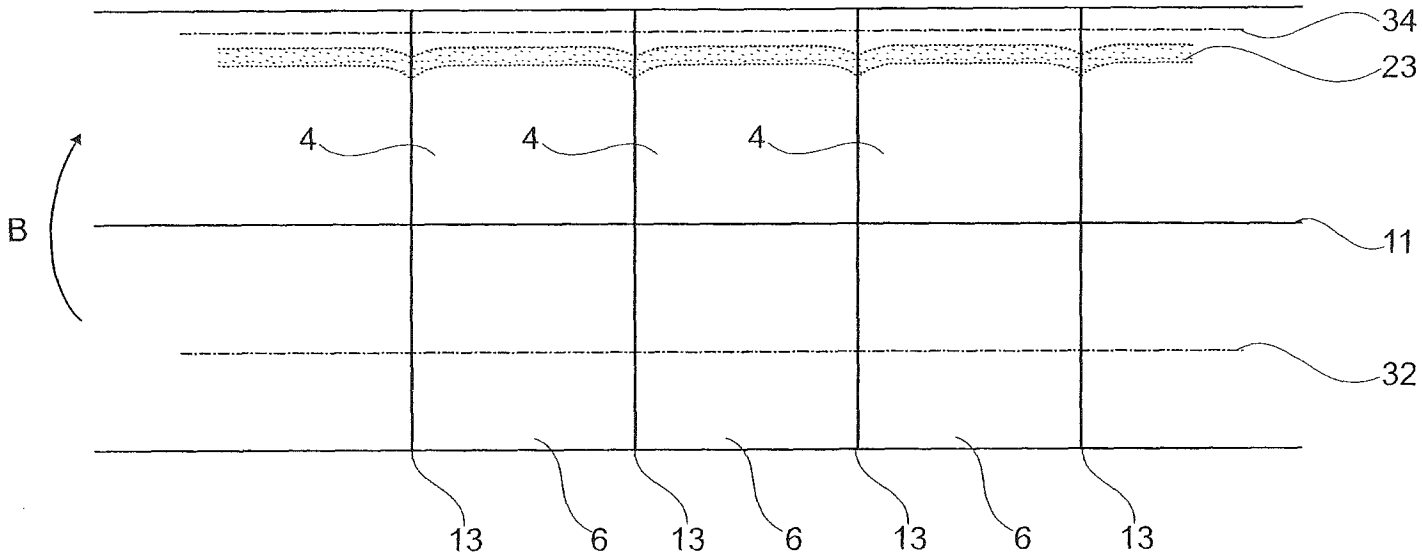
FIG. 10 shows a schematic view of a film material used for manufacturing the resealable package shown in FIG. 9(*a*) to (*d*)

A method of manufacturing the resealable package 1' of the embodiment shown in FIG. 9 will be described in the following with reference to FIG. 10. FIG. 10 shows a plan view of a layer or a web of a plastic film material, such as polyethylene, having a thickness in the range from 0.1 to 1.0 mm. In the manufacturing process of the package 1', the film material is provided with the resealable adhesive layer 23 and the first and second lines of weakness 32, 34. As can be seen from FIG. 10, the resealable adhesive layer 23 is arranged between the first and second lines of weakness 32, 34.

The film material is folded along a fold, line 11 which extends between the first and second lines of weakness 32, 34 in a direction parallel thereto, so as to bring the lower edge of the film material towards the upper edge of the film material, as is indicated by arrow B in FIG. 10. Further, the film material is cut along cut lines 13 extending in a direction substantially perpendicular to the fold line 11. Finally, a top edge 19 of the package 1' (see FIG. 9(*b*)), which is formed by the upper and lower edges of the film material shown in FIG. 10, and lateral edges of the package 1', which extend along the cut lines 13, are sealed by using an adhesive material, heat welding or the like, thus forming the package 1' as shown in FIG. 9.

Figure 11:
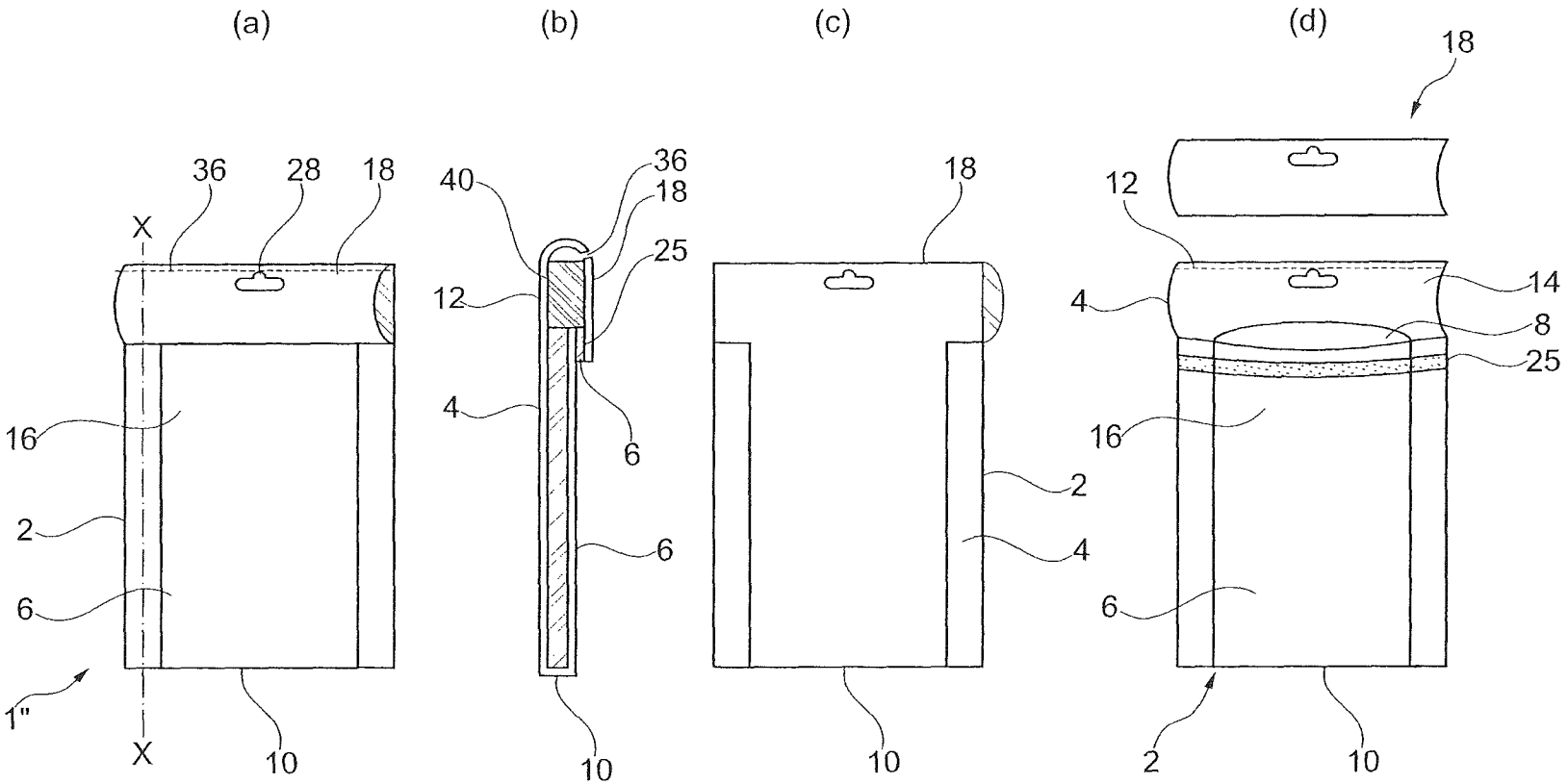
FIG. 11(*a*) to (*d*) show schematic views illustrating a resealable package according to yet another embodiment of the present invention, wherein FIG. 11(*a*) is a front view of the package, FIG. 11(*b*) is a cross-sectional view of the package along the line X-X shown in FIG. 11(*a*), FIG. 11(*c*) is a rear view of the package and FIG. 11(*d*) is a front view of the package with the closure element being removed from the package.

FIG. 11(*a*) to (*d*) show schematic views illustrating a resealable package 1" according to yet another embodiment of the present invention. FIG. 11(*a*) is a front view of the package 1", FIG. 11(*b*) is a cross-sectional view of the package 1" along the line X-X shown in FIG. 11(*a*), FIG. 11(*c*) is a rear view of the package 1" and FIG. 11(*d*) is a front view of the package 1" with the closure element 1 being removed from the package 1". For reasons of simplicity, the same reference signs as in FIGS. 1 to 6 and 9 are used to denote similar or identical elements.

The package 1" of the embodiment shown in FIG. 11(*a*) to (*d*) differs from the package 1' of the embodiment shown in FIG. 9(*a*) to (*d*) mainly in that a resealable adhesive layer 25, such as a pressure sensitive adhesive, is provided between the closure element 18 and the outer surface 16 of the second side wall 6. A bonding strength of the resealable adhesive layer 25 to the outer surface 16 of the second side wall 6 is higher than a bonding strength of the resealable adhesive layer 25 to the closure element 18, so that, after removal of the closure element 18 from the package body 2, the resealable adhesive layer 25 remains on the outer surface 16 of the second side wall 6, as is schematically shown in FIG. 11(*d*).

Moreover, the package 1" of the embodiment shown in FIG. 11(*a*) to (*d*) comprises a single line of weakness 36, such as a perforation, a score line or the like, which is provided in the top edge of the package 1" (see FIG. 11(*b*)) so as to extend in a widthwise direction of the package 1", i.e., in a direction perpendicular to the direction from the bottom end 10 to the top end 8. Preferably, the line of weakness 36 extends across the entire width of the package. 1".

Further, a first layer of a peelable adhesive 40 is provided between the closure element 18 and the inner surface 14 of the portion 12 of the first side wall 4 which protrudes beyond the second side wall 6. A second layer of a peelable adhesive 42 is provided between the closure element 18 and the outer surface 16 of the second side wall 6. As can be seen, for example, from FIG. 11(*b*), the first peelable adhesive layer 40 is arranged above the resealable adhesive layer 25 and the second peelable adhesive layer 42 is arranged below the resealable adhesive layer 25 in the direction from the bottom end 10 to the top end 8.

The bonding strengths of the first and second peelable adhesive layers 40, 42 to the closure element 18 and the first and second side walls 4, 6, respectively, may be chosen so that, after removal of the closure element 18 from the package body 2, both peelable adhesive. 40, 42 remain on the closure element 18, both peelable adhesive layers 40, 42 remain on the package body 2, or one of the peelable adhesive layers 40, 42 remains on the closure element 18 and the other of the peelable adhesive layers 40, 42 remains on the package body 2.

The line of weakness 36 and the first and second peelable adhesive layers 40, 42 facilitate removal of the closure element 18 from the package body 2 and thus assist a consumer in opening the package 1", as will be detailed in the following. In order to remove the closure element 18 from the package body 2, the closure element 18, for example, may be held at the area of the punched hole 28 and peeled off the package body 2 in the same manner as schematically shown in FIG. 3, thereby rupturing the line of weakness 36 and breaking the seal provided by the first and second peelable adhesive layers 40, 42. In this way, the closure element 18 is fully removed from the package body 2, while the resealable adhesive layer 25 remains on the outer surface 16 of the second side wall 6 (see FIG. 11(*d*)).

In order to reseal the package 1", the protruding portion 12 of the first side wall 4 is folded over towards the bottom end of the package body 2 so as to bring the protruding portion 12 into contact with the resealable adhesive layer 25 provided on the outer surface 16 of the second side wall 6. The resealable adhesive layer 25 and the inner surface 14 are made to resealably adhere to one another by applying a slight pressure to the top end 8 of the package body 2.

Furthermore, instead of a package configuration as shown in FIGS. 9 and 11, in which a single resealable adhesive layer 23, 25 is used, a package configuration with two or more resealable adhesive layers, such as pressure sensitive adhesive layers, may be employed. For example, the package may have a first resealable adhesive layer and a second resealable adhesive layer. In this case, bonding strengths of the first and second resealable adhesive layers to the closure element 18 and the first and/or second side walls 4, 6 may be chosen so that, after removal of the closure, element 18 from the package body 2, both resealable adhesive layers remain on the closure element 18, both resealable adhesive layers remain on the package body 2, or one of the resealable adhesive layers remains on the closure element 18 and the other of the resealable adhesive layers remains on the package body 2.

In particular, the package 1' of the embodiment shown in FIG. 9(*a*) to (*d*) may be modified by providing a second resealable adhesive layer, such as a pressure sensitive adhesive layer, e.g., between the closure element 18 and the outer surface 16 of the second side wall 6. A bonding strength of the second resealable adhesive layer to the outer surface 16 of the second side wall 6 may be chosen to be lower than a bonding strength of the second resealable adhesive layer to the closure element 18, so that, after removal of the closure element 18 from the package body 2, the second resealable adhesive layer remains on the closure element 18, while the first resealable adhesive layer 23 remains on the package body 2. Alternatively, the bonding strengths of the first resealable adhesive layer 23 and the second resealable adhesive layer may be chosen so that, after removal of the closure element 18 from the package body 2, the first resealable adhesive layer 23 remains on the closure element 18, while the second resealable adhesive layer remains on the package body 2.

Figure 12:
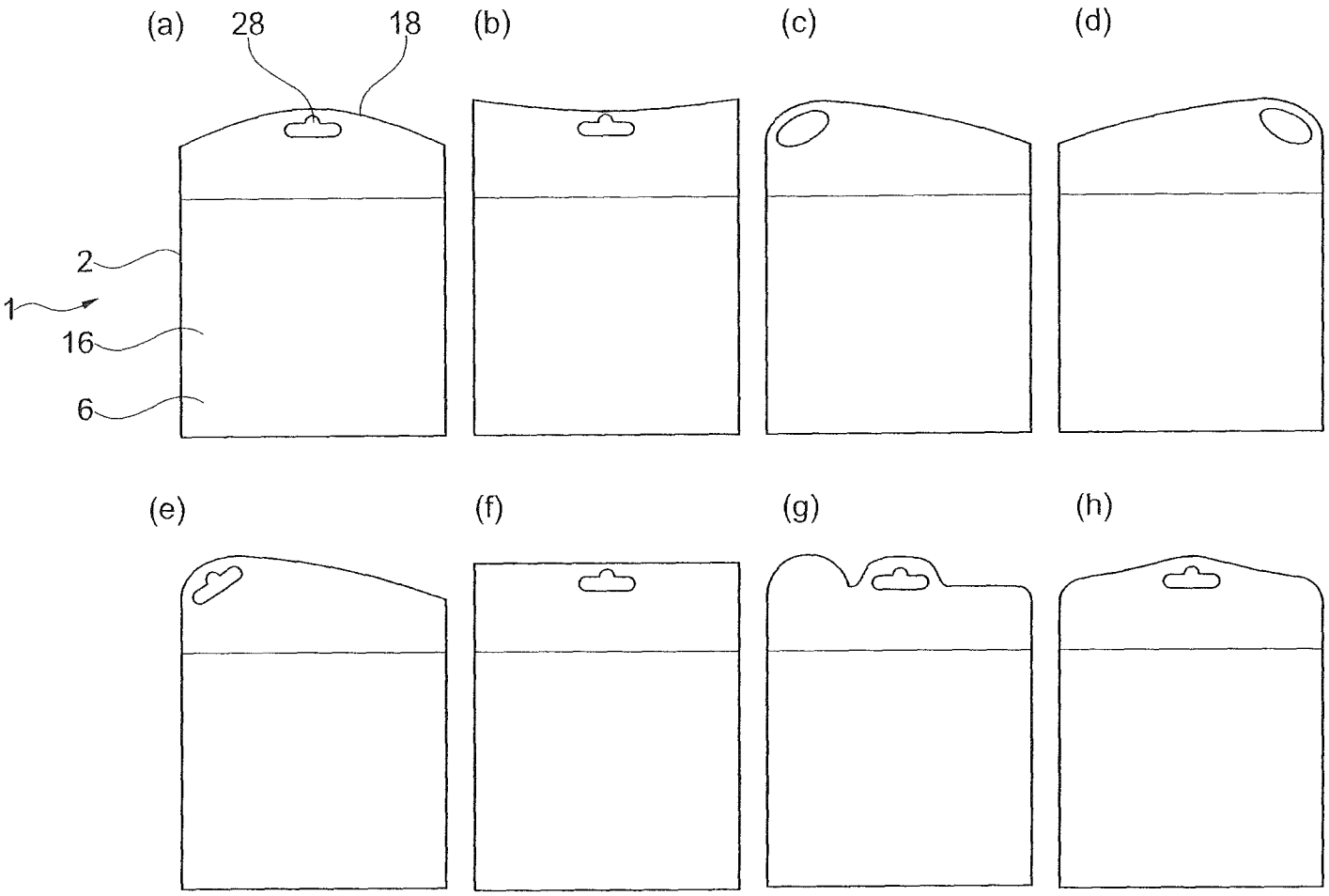
FIG. 12(*a*) to (*h*) show schematic views of different embodiments of the resealable package according to the present invention.

As has been detailed above, there are substantially no restrictions with regard to the shaping of the closure element 18. Specifically, the closure element 18 can be out, punched, stamped, notched, perforated or otherwise formed into any desired shape, as is schematically shown in FIG. 12(*a*) to (*h*). The shaping of the closure element 18 can be performed in a particularly simple and efficient manner, if the closure element 18 is produced separately from the package body 2 and subsequently attached thereto.

For example, the upper edge of the closure element 18 may be cut so as to have a straight shape (FIG. 12(*f*)), a convex curved shape (FIGS. 12(*a*), (*c*), (*d*) and (*e*)), a concave curved shape (FIG. 12(*b*)) or an irregular shape (FIGS. 12(*g*) and (*h*)). Further, the closure element 18 may be provided with one or more punched holes 28 of varying shapes and sizes, which may serve as a hanger structure for hanging the package 1 onto a support element, such as a hook.

Figure 13:
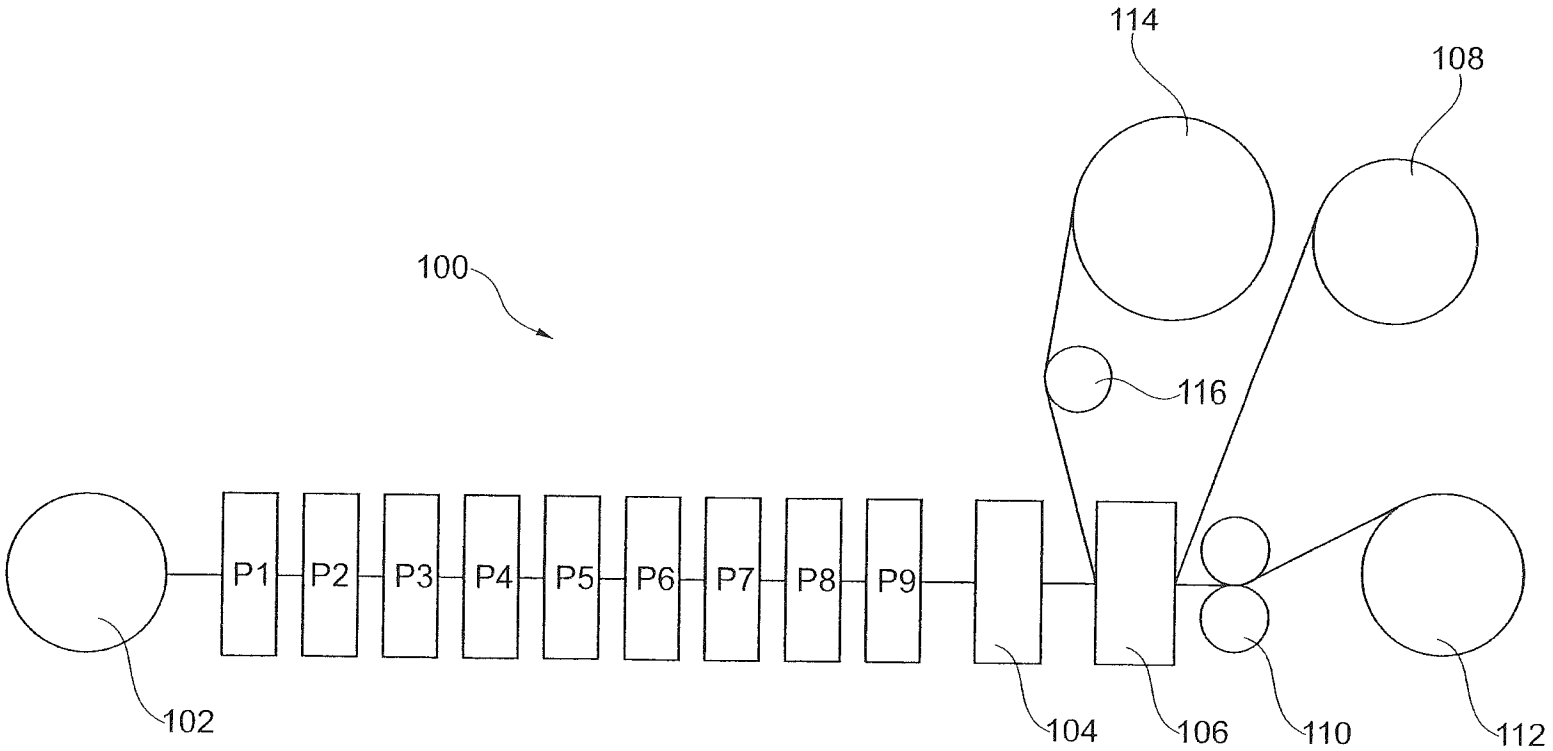
FIG. 13 shows a schematic view of part of an apparatus for producing the resealable package according to an embodiment of the present invention.

The package body 2 of the packages 1, 1', 1" of the embodiments of the invention discussed above may, for example, be formed from a film web using conventional package forming equipment. The closure element 18 may be produced separately from the package body 2 and subsequently attached thereto. FIG. 13 shows a schematic view of part of an apparatus 100 for producing a resealable package 1 according to an embodiment of the present invention.

As can be seen from FIG. 13, the apparatus 100 comprises a material supply 102, such as a roll, for supplying a material (e.g., a film made of a plastic material, such as polyethylene) for the closure element 18, a plurality of printing stations P1 to P9 for printing decorative elements and/or information, such as a brand or company name, onto the closure element 18 material, an adhesive applying device 104 configured to provide the resealable adhesive arrangement (e.g., the first and second cold seal adhesive layers 20, 22) onto the printed closure element 18 material and a cutting device 106 configured to cut the printed closure element 18 material with the adhesive arrangement 20, 22 provided thereon into a predetermined shape so as to form the closure element 18. For example, the cutting device 106 may be configured to provide one or more punched holes 28 and/or one or more lines of weakness 30, such as cuts, perforations or the like, to the closure element 18.

The closure element 18 thus formed is subsequently guided through a pair of guiding rolls 110 and transported to an attachment device (not shown) via a transport roll 112. The attachment device forms part of the apparatus 100 and is configured to releasably adhere the closure element 18 to the inner surface 14 of the protruding portion 12 of the first side wall 4 and the outer surface 16 of the second side wall 6 of the package body 2 so as to close the top end 8 thereof, thus forming the resealable package 1 of the embodiment of the invention.

The attachment device may be, for example, formed of a pair of rollers having a nip with a predetermined width formed therebetween. In this case, the package body 2 and the closure element 18 are guided through the nip between, the rollers and the pressure applied onto the closure element 18 and the package body 2 by the rollers effects a releasable adhesion of the closure element 18 to the top end 8 of the package body 2. Alternatively, a press unit or the like, which is capable of applying the pressure required for releasably adhering the closure element 18 to the package body 2, may be used as the attachment device.

The apparatus 100 of the embodiment shown in FIG. 13 further comprises a scrap removing device 108, which is configured to remove any scrap material produced during the process of cutting the closure element 18 material in the cutting device 106. Moreover, the apparatus 100 optionally may comprise a support material supply 114 which is configured to supply a support material, such as a backer paper or the like, to the closure element 18 material prior to or after the cutting in the cutting device 106. The support material serves to provide support to the closure element 18 material during the subsequent transport process and may be supplied from the support material supply 114 to the cutting device 106 via a guide roll 116.

Moreover, the apparatus 100 may further comprise a coating device (not shown) configured to provide one or more coating layers 24, 26 as described above, i.e., coating layers for reducing pressure banding in the rolls of the apparatus 100 and/or sealant layers, on the closure element 18. The coating device may be provided in the apparatus 100, for example, before the adhesive applying device 104, between the adhesive applying device 104 and the cutting device 106 or after the cutting device 106. Further, a plurality of coating devices may be arranged in the apparatus 100. Alternatively, the adhesive applying device 104 may be configured so that it not only provides the resealable adhesive arrangement 20, 22 but also one or more coating layers 24, 26.

Before the closure element 18 is releasably adhered to the top end 8 of the package body 2 by the attachment device, thereby closing the top end 8 of the package body 2, the package body 2 is filled with a desired product at a filling unit (not shown). Due to the resealing functionality of the package 1 provided by the resealable adhesive arrangement 20, 22, the package 1 can be particularly advantageously used for containing therein food products, such as sweets, chocolate, cookies, nuts, savoury snacks, coffee beans, coffee powder, beverages or the like. After the filling with the product or products has been performed, the closure element 18 is adhered to the top end 8 of the package body 2, thereby completing the resealable package 1 of the embodiment of the invention.

While the packages 1, 1', 1" of the embodiments shown in FIGS. 1 to 6, 9, 11 and 12 have substantially rectangular shapes, the invention is not limited to this type of shape but may be applied to packages with any kind of shapes or sizes.

The invention claimed is:

1. A resealable package, comprising a package body having a first side wall, a second side wall opposite the first side wall, an openable top end and a closed bottom end, wherein a portion of the first side wall protrudes beyond the second side wall at the top end in a direction from the bottom end to the top end, wherein, when the package is in a closed configuration, an outer surface of the first side wall is located at a first outer surface of the package, and an outer surface of the second side wall is located at a second outer surface of the package opposite the first outer surface, and a removable closure element with a first adhesive arrangement and a second adhesive arrangement applied to a common surface of the closure element, the first adhesive arrangement and second adhesive arrangement being applied to separate and distinct areas of the common surface of closure element and out of adherence to each other;

wherein the closure element is releasably adhered to an inner surface of the portion of the first side wall which protrudes beyond the second side wall and the second outer surface via the first adhesive arrangement so as to close and seal the top end, and releasably adhered to at least one of the inner surface of the first side wall and the second outer surface via the second adhesive arrangement that is resealable and distinct from the first adhesive arrangement, and wherein, upon removal of the closure element from the package body, the first adhesive arrangement remains with the closure element and the second adhesive arrangement is left behind on at least one of the inner surface of the first side wall and the second outer surface, the second adhesive arrangement allowing the inner surface of the portion of the first side wall which protrudes beyond the second side wall and the second outer surface to be resealably adhered to one another in a position to close the top end.

2. The resealable package according to claim 1, wherein the second adhesive arrangement comprises a pressure sensitive adhesive.

3. The resealable package according to claim 1, wherein the closure element is independently formed from the package body.

4. The resealable package according to claim 1, wherein the second adhesive arrangement comprises a cold seal.

5. The resealable package according to claim 1, wherein the second adhesive arrangement comprises:

a first cold seal adhesive layer is provided between the closure element and the inner surface of the portion of the first side wall which protrudes beyond the second side wall, and a second cold seal adhesive layer is provided between the closure element and the outer surface of the second side wall, wherein a bonding strength of the first cold seal adhesive layer to the inner surface of the portion of the first side wall which protrudes beyond the second side wall is higher than a bonding strength of the first cold seal adhesive layer to the closure element, so that, after removal of the closure element from the package body, the first cold seal adhesive layer remains on the inner surface of the portion of the first side wall which protrudes beyond the second side wall, and a bonding strength of the second cold seal adhesive layer to the outer surface of the second side wall is higher than a bonding strength of the second cold seal adhesive layer to the closure element, so that, after removal of the closure element from the package body, the second cold seal adhesive layer remains on the outer surface of the second side wall.

6. The resealable package according to claim 1, wherein the first adhesive arrangement is a coating layer is provided on the closure element.

7. The resealable package according to claim 6, wherein the second adhesive arrangement comprises:

a first cold seal adhesive layer is provided between the closure element and the inner surface of the portion of the first side wall which protrudes beyond the second side wall, and a second cold seal adhesive layer is provided between the closure element and the outer surface of the second side wall, wherein a bonding strength of the first cold seal adhesive layer to the inner surface of the portion of the first side wall which protrudes beyond the second side wall is higher than a bonding strength of the first cold seal adhesive layer to the closure element, so that, after removal of the closure element from the package body, the first cold seal adhesive layer remains on the inner surface of the portion of the first side wall which protrudes beyond the second side wall, and a bonding strength of the second cold seal adhesive layer to the outer surface of the second side wall is higher than a bonding strength of the second cold seal adhesive layer to the closure element, so that, after removal of the closure element from the package body, the second cold seal adhesive layer remains on the outer surface of the second side wall; and wherein the coating layer is provided on the closure element between the first cold seal adhesive layer and the second cold seal adhesive layer.

8. The resealable package according to claim 6, wherein the coating layer is a sealant layer forming a seal between the closure element and the top end of the package body.

9. The resealable package according to claim 8, wherein a bonding strength of the coating layer to the closure element is higher than a bonding strength of the coating layer to the top end of the package body, so that, after removal of the closure element from the package body, the coating layer remains on the closure element.

10. The resealable package according to claim 1, wherein the first adhesive arrangement is a first coating layer and a second coating layer provided on the closure element.

11. The resealable package according to claim 10, wherein the second adhesive arrangement comprises a first cold seal adhesive layer is provided between the closure element and the inner surface of the portion of the first side wall which protrudes beyond the second side wall, and a second cold seal adhesive layer is provided between the closure element and the outer surface of the second side wall, wherein a bonding strength of the first cold seal adhesive layer to the inner surface of the portion of the first side wall which protrudes beyond the second side wall is higher than a bonding strength of the first cold seal adhesive layer to the closure element, so that, after removal of the closure element from the package body, the first cold seal adhesive layer remains on the inner surface of the portion of the first side wall which protrudes beyond the second side wall, and a bonding strength of the second cold seal adhesive layer to the outer surface of the second side wall is higher than a bonding strength of the second cold seal adhesive layer to the closure element so that, after removal of the closure element from the package body the second cold seal adhesive layer remains on the outer surface of the second side wall; and wherein the first coating layer and the second coating layer are provided on the closure element between the first cold seal adhesive layer and the second cold seal adhesive layer.

12. The resealable package according to claim 10, wherein the first coating layer is provided between the closure element and the inner surface of the portion of the first side wall which protrudes beyond the second side wall and the second coating layer is provided between the closure element and the outer surface of the second side wall.

13. The resealable package according to claim 10, wherein the first and second coating layers are sealant layers forming a seal between the closure element and the top end of the package body.

14. The resealable package according to claim 13, wherein the first coating layer is provided between the closure element and the inner surface of the portion of the first side wall which protrudes beyond the second side wall and the second coating layer is provided between the closure element and the outer surface of the second side wall;

and wherein a bonding strength of the first coating layer to the closure element is higher than a bonding strength of the first coating layer to the inner surface of the portion of the first side wall which protrudes beyond the second side wall, so that, after removal of the closure element from the package body, the first coating layer remains on the closure element.

15. The resealable package according to claim 14, wherein a bonding strength of the second coating layer to the closure element is higher than a bonding strength of the second coating layer to the outer surface of the second side wall, so that, after removal of the closure element from the package body, the second coating layer remains on the closure element.

16. The resealable package according to claim 1, wherein the package body and the closure element are made of different materials.

17. The resealable package according to claim 1, wherein the closure element has a sheet-like shape.

18. The resealable package according to claim 1, wherein a thickness of the closure element is greater than a thickness of the first and second side walls.

19. The resealable package according to claim 1, wherein prior to removal of the closure element from the package body, the first adhesive arrangement is two adhesive layers applied to the closure element, and the second adhesive arrangement is two adhesive layers applied to the closure element.

20. The resealable package according to claim 19, wherein the two adhesive layers of the first adhesive arrangement are disposed between the two adhesive layers of the second adhesive arrangement.

* * * * *